US008303734B2

(12) United States Patent
Yoshida et al.

(10) Patent No.: US 8,303,734 B2
(45) **Date of Patent: *Nov. 6, 2012**

(54) HIGH STRENGTH THICK STEEL MATERIAL AND HIGH STRENGTH GIANT H-SHAPE EXCELLENT IN TOUGHNESS AND WELDABILITY AND METHODS OF PRODUCTION OF SAME

(75) Inventors: Suguru Yoshida, Tokyo (JP); Hiroshi Kita, Tokyo (JP); Teruhisa Okumura, Tokyo (JP); Hirokazu Sugiyama, Tokyo (JP); Teruyuki Wakatsuki, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 189 days.

This patent is subject to a terminal disclaimer.

(21) Appl. No.: 12/865,961

(22) PCT Filed: Sep. 26, 2008

(86) PCT No.: PCT/JP2008/067993

§ 371 (c)(1),
(2), (4) Date: Aug. 3, 2010

(87) PCT Pub. No.: WO2010/013358

PCT Pub. Date: Feb. 4, 2010

(65) Prior Publication Data

US 2010/0330387 A1 Dec. 30, 2010

(30) Foreign Application Priority Data

Jul. 30, 2008 (JP) ..... 2008-196908

(51) Int. Cl.

| | |
|---|---|
| ***C22C 38/12*** | (2006.01) |
| ***C22C 38/14*** | (2006.01) |
| ***C21D 8/02*** | (2006.01) |
| ***C21C 7/072*** | (2006.01) |

(52) U.S. Cl. ..... 148/330; 148/332; 148/334; 148/335; 148/336; 148/541; 148/546; 148/548; 148/648; 148/654; 420/109; 420/110; 420/126; 420/127; 75/508

(58) Field of Classification Search ..... 148/320, 148/330, 332–336, 541, 546, 548, 648, 654; 420/110, 126, 127, 109; 75/508
See application file for complete search history.

(56) References Cited

U.S. PATENT DOCUMENTS 6,364,967 B1 * 4/2002 Yamamoto et al. ..... 148/320

(Continued)

FOREIGN PATENT DOCUMENTS

EP 0999288 A1 5/2000

(Continued)

OTHER PUBLICATIONS

Machine-English translation of Japanese patent No. 10-147834, Yamamoto Koichi et al., Jun. 2, 1998.*

(Continued)

*Primary Examiner* — Deborah Yee
(74) *Attorney, Agent, or Firm* — Birch, Stewart, Kolasch & Birch, LLP

(57) ABSTRACT

The present invention provides a high strength thick steel material excellent in toughness and weldability reduced in amount of C and amount of N, containing suitable amounts of Si, Mn, Nb, Ti, B, and O, having contents of C and Nb satisfying C—Nb/7.74≦0.004, having a density of Ti-containing oxides of a particle size of 0.05 to 10 μm of 30 to 300/mm$^2$, and having a density of Ti-containing oxides of a particle size over 10 μm of 10/mm$^2$ or less, produced by treating steel by preliminary deoxidation to adjust the dissolved oxygen to 0.005 to 0.015 mass %, then adding Ti and, furthermore, vacuum degassing the steel for 30 minutes or more, smelting it, then continuously casting it to produce a steel slab or billet, heating the steel slab or billet to 1100 to 1350° C., hot rolling the slab or billet to a thickness of 40 to 150 mm, then cooling it.

18 Claims, 6 Drawing Sheets

U.S. PATENT DOCUMENTS

| | | | | |
|---|---|---|---|---|
| 6,451,134 | B1 | 9/2002 | Kimura et al. | |
| 8,097,096 | B2 * | 1/2012 | Yoshida et al. | 148/320 |

FOREIGN PATENT DOCUMENTS

| | | | |
|---|---|---|---|
| EP | 1143023 | A1 | 10/2001 |
| JP | 1-176017 | A | 7/1989 |
| JP | 1-219118 | A | 9/1989 |
| JP | 4-83821 | A | 3/1992 |
| JP | 8-158006 | A | 6/1996 |
| JP | 9-310117 | A | 12/1997 |
| JP | 11-172373 | A | 6/1999 |
| JP | 11-193440 | A | 7/1999 |
| JP | 2000-199011 | A | 7/2000 |
| JP | 2001-9503 | A | 1/2001 |
| JP | 2001-89828 | A | 4/2001 |
| JP | 2002-173734 | A | 6/2002 |
| JP | 2005-105322 | A | 4/2005 |
| JP | 2005-232515 | A | 9/2005 |
| JP | 2006-124759 | A | 5/2006 |
| JP | 2008-95201 | A | 4/2008 |

OTHER PUBLICATIONS

Machine-English translation of Japanese patent No. 09-137218, Kimura Tatsuki et al., May 27, 1997.*

Extended European Search Report for European Application No. 08876657.1 mailed Nov. 30, 2011.

* cited by examiner

HIGH STRENGTH THICK STEEL MATERIAL AND HIGH STRENGTH GIANT H-SHAPE EXCELLENT IN TOUGHNESS AND WELDABILITY AND METHODS OF PRODUCTION OF SAME

TECHNICAL FIELD

The present invention relates to a thick steel material and giant H-shape excellent in strength, toughness, and weldability suitable for column members of high story buildings, structural members of giant steel structure facilities, etc. and methods of production of the same.

BACKGROUND ART

High-rise buildings, indoor sports facilities, etc. are steel structure facilities in which giant space is required to be secured. As structural members for the same, high strength thick steel materials or giant H-shapes are being utilized. If steel plates or steel shapes increase in thickness, in particular, securing the amount of reduction at the center of the plate thickness becomes difficult and variations in material quality become a problem. Further, if securing hardenability by raising the carbon equivalent (Ceq), the weldability ends up falling.

To deal with this problem, methods of improving the weldability and toughness of high strength thick steel material are, for example, proposed in Japanese Patent Publication (A) No. 9-310117, Japanese Patent Publication (A) No. 2000-199011, Japanese Patent Publication (A) No. 2002-173734, etc.

The method proposed in Japanese Patent Publication (A) No. 9-310117 and Japanese Patent Publication (A) No. 2000-199011 reduces the amount of C, lowers the weld cracking susceptibility parameter (Pcm), and makes the metal structure a bainite single-phase structure or granular bainitic ferrite to reduce variations in material quality.

Further, the thick steel material proposed in Japanese Patent Publication (A) No. 2002-173734 is made of ingredients reducing the Ceq and Pcm and utilizes solid solution Nb to obtain a strength and toughness in accordance with the application.

Furthermore, an giant H-shape comprised of not just steel plate, but an extremely low carbon bainite structure into which quasi polygonal ferrite is dispersed is for example proposed in Japanese Patent Publication (A) No. 11-193440.

The methods proposed in these patent citations omit heat treatment and utilize controlled rolling to obtain giant H-shapes excellent in strength and toughness.

DISCLOSURE OF INVENTION

With thick steel materials of a thickness of 40 mm or more, in particular, giant H-shapes, securing the amount of work by hot rolling is difficult. Furthermore, the cooling speed after the hot rolling becomes slower. Therefore, it is difficult to refine the microstructure of the steel and difficult to secure toughness.

Further, if the steel material increases in thickness and if raising the strength, the variations in material quality and the drop in toughness of the weld heat affected zone (HAZ) also become problems.

The present invention provides a high strength thick steel material and a high strength giant H-shape excellent in strength and toughness and, furthermore, weldability, without applying heat treatment after hot rolling, and methods of production of the same.

The high strength thick steel material and high strength giant H-shape of the present invention have Nb and B, which exhibit the effect of sufficiently improving the hardenability even with small amounts of addition, added to them and are restricted in the dispersion of fine oxides and formation of coarse oxides, so are improved in toughness and kept from falling in HAZ toughness.

Further, in the methods of production of a high strength thick steel material and a high strength giant H-shape of the present invention, in particular, control of the oxides is important. In the steelmaking process for smelting steel, before adding the Ti, the concentration of dissolved oxygen is controlled to a suitable range, the Ti is added, then the steel is vacuum degassed.

The gist of the present invention is as follows:

(1) A high strength thick steel material excellent in toughness and weldability characterized by containing, by mass %, C: 0.005% to 0.030%,
Si: 0.05% to 0.50%,
Mn: 0.4% to 2.0%,
Nb: 0.02% to 0.25%,
Ti: 0.005% to 0.025%,
B: 0.0003% to 0.0030%, and
O: 0.0005% to 0.0035%, limited to P: 0.030% or less,
S: 0.020% or less, and
N: 0.0045% or less, and having a balance of Fe and unavoidable impurities, having contents of C and Nb satisfying $$C—Nb/7.74 \leqq 0.02,$$

having a density of Ti-containing oxides of a particle size of 0.05 to 10 μm of 30 to 300/mm$^2$, and having a density of Ti-containing oxides of a particle size over 10 μm of 10/mm$^2$ or less.

(2) A high strength thick steel material excellent in toughness and weldability as set forth in (1) characterized by further containing, by mass %, one or both of:

V: 0.1% or less and
Mo: 0.1% or less.

(3) A high strength thick steel material excellent in toughness and weldability as set forth in (1) or (2) characterized by further containing, by mass %, one or both of Al: less than 0.025% and
Mg: 0.005% or less.

(4) A high strength thick steel material excellent in toughness and weldability as set forth in any one of (1) to (3) characterized by further containing, by mass %, one or both of Zr: 0.03% or less and
Hf: 0.01% or less.

(5) A high strength thick steel material excellent in toughness and weldability as set forth in any one of (1) to (4) characterized by further containing, by mass %, one or more of Cr: 1.5% or less,
Cu: 1.0% or less, and
Ni: 1.0% or less.

(6) A high strength thick steel material excellent in toughness and weldability as set forth in any one of (1) to (5) characterized by further containing, by mass %, one or both of REM: 0.01% or less and
Ca: 0.005% or less.

(7) A high strength thick steel material excellent in toughness and weldability as set forth in any one of (1) to (6) characterized in that a mass % concentration product of the Nb and C is 0.00015 or more.

(8) A high strength giant H-shape excellent in toughness and weldability characterized by comprising a high strength thick steel material excellent in toughness and weldability as set forth in any one of (1) to (7) and having a flange thickness of 40 mm or more.

(9) A high strength giant H-shape excellent in toughness and weldability as set forth in (8) characterized in that the high strength giant H-shape has a yield strength of 450 MPa or more, a tensile strength of 550 MPa or more, and a Charpy absorbed energy at 0° C. of a value of 47 J or more.

(10) A method of production of a high strength thick Steel material excellent in toughness and weldability as set forth in any one of (1) to (7), the method of production characterized by smelting steel comprised of a composition of ingredients as set forth in any one of (1) to (7) during which performing preliminary deoxidation to adjust the dissolved oxygen to 0.005 to 0.015 mass %, then adding Ti, furthermore vacuum degassing for 30 minutes or more for smelting, after smelting, continuously casting to produce a steel slab or billet, heating the steel slab or billet to 1100 to 1350° C., then hot rolling the steel slab or billet, then cooling a hot rolled steel material.

(11) A method of production of a high strength thick Steel material excellent in toughness and weldability as set forth in (10) characterized by heating the steel slab or billet to 1100 to 1350° C., then hot rolling to give a cumulative reduction rate at 1000° C. or less of 10% or more.

(12) A method of production of a high strength thick Steel material excellent in toughness and weldability as set forth in (10) or (11) characterized in that the hot rolling is comprised of primary rolling and secondary rolling and by rolling the steel slab or billet in primary rolling, then cooling the steel slab or billet to 500° C. or less, then reheating the steel slab or billet to a temperature region of 1100 to 1350° C., then rolling the steel slab or billet in secondary rolling to give a cumulative reduction rate at 1000° C. or less of 10% or more.

(13) A method of production of a high strength thick Steel material excellent in toughness and weldability as set forth in any one of (10) to (12) characterized by, after the hot rolling, cooling the steel material in an average cooling rate of 0.1 to 10° C./s in a 800° C. to 500° C. temperature range.

(14) A method of production of a high strength giant H-shape excellent in toughness and weldability as set forth in (8) or (9), the method of production giant H-shape excellent in toughness and weldability characterized by smelting steel comprised of a composition of ingredients as set forth in any one of claims 1 to 7 during which performing preliminary deoxidation to adjust the dissolved oxygen to 0.005 to 0.015 mass %, then adding Ti, furthermore vacuum degassing for 30 minutes or more for smelting, after smelting, continuously casting to produce a steel slab or billet, heating the steel slab or billet to 1100 to 1350° C., then hot rolling the steel slab or billet to produce a giant H-shape with a flange thickness of 40 mm or more, then cooling the giant H-shape.

(15) A method of production of a high strength giant H-shape excellent in toughness and weldability as set forth in (14) characterized by heating the steel slab or billet to a temperature of 1100 to 1350° C., then hot rolling the steel slab or billet to give a cumulative reduction rate at 1000° C. or less of 10% or more.

(16) A method of production of a high strength giant H-shape excellent in toughness and weldability as set forth in (14) or (15) characterized in that the hot rolling is comprised of primary rolling and secondary rolling and by rolling the steel slab or billet in primary rolling, then cooling the steel slab or billet to 500° C. or less, then reheating the steel slab or billet to a temperature region of 1100 to 1350° C., then rolling the steel slab or billet in secondary rolling to give a cumulative reduction rate at 1000° C. or less of 10% or more.

(17) A method of production of a high strength giant H-shape excellent in toughness and weldability as set forth in any one of (14) to (16) characterized by, after the hot rolling, cooling the giant H-shape in an average cooling rate of 0.1 to 10° C./s in a 800° C. to 500° C. temperature range.

According to the present invention, it becomes possible to produce a high strength thick steel material excellent in toughness and weldability, in particular, a high strength giant H-shape, without heat treatment for thermal refining after rolling, by cooling as is after rolling.

BEST MODE FOR CARRYING OUT THE INVENTION

Figure 1:
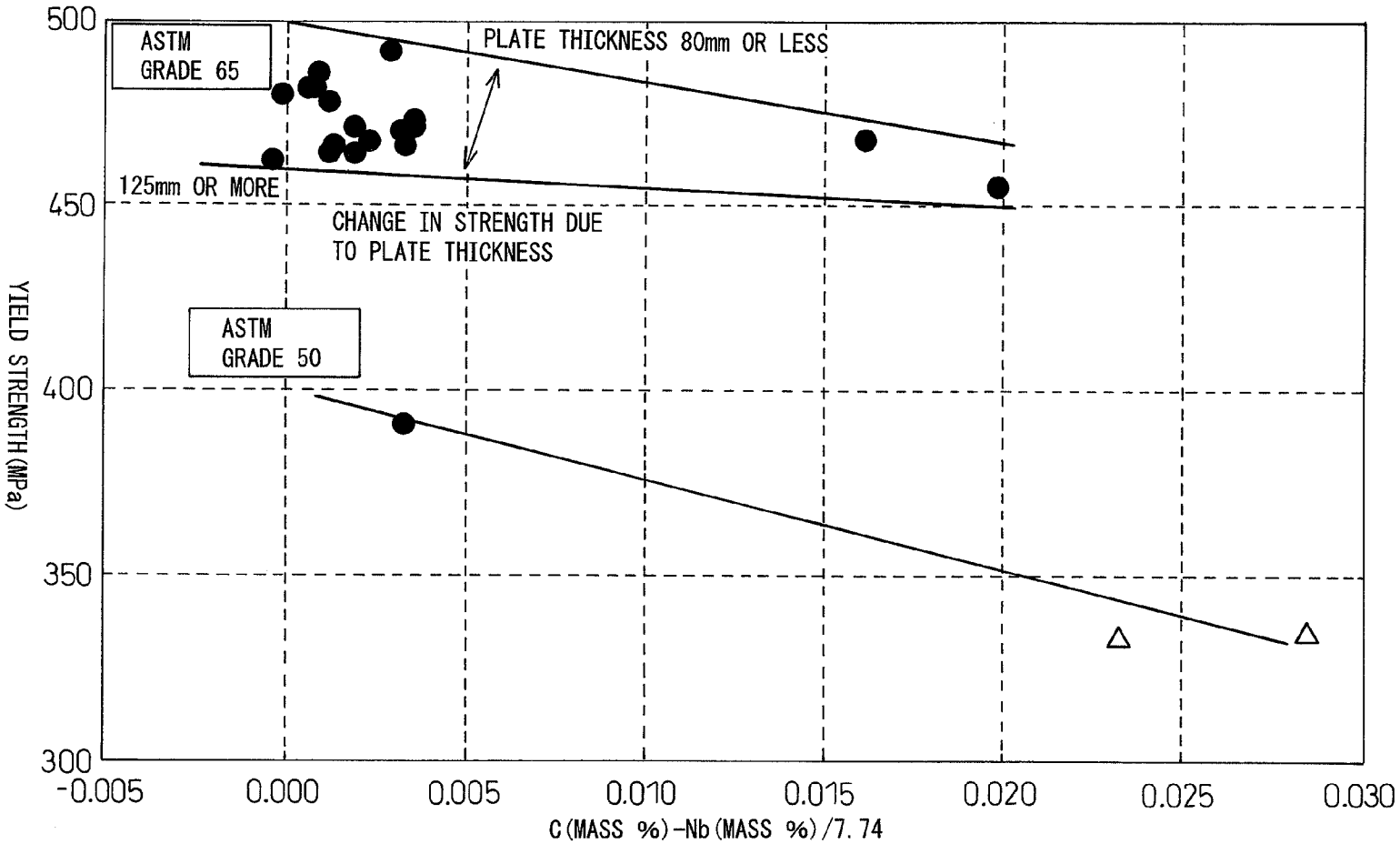
FIG. 1 is a view showing the relationship between a value of C—Nb/7.74 and a yield strength of a steel material at ordinary temperature.

To secure the strength and toughness of a steel material, refining the crystal grains is extremely effective. However, if employing carbonitrides or other precipitates, the strength will rise due to the precipitation strengthening, but the toughness will end up dropping.

In particular, if a steel material is increased in thickness, the reduction rate by hot rolling cannot be secured and refinement of the crystal grains becomes difficult. Further, if a steel material is increased in thickness, at the center of thickness of the steel plate or H-beam, the cooling speed after hot rolling will fall and formation of massive ferrite and bainite superior in strength and toughness will become inhibited.

Furthermore, if reducing the amount of C to raise the toughness and weldability, the strength will fall, so for improvement of solution strengthening or hardenability, alloy elements have to be added. However, if adding expensive Mo or Ni or other alloy elements in large amounts, the production costs will increase. To suppress an increase in production costs, addition of elements remarkably contributing to the increase of strength by a small amount of addition becomes necessary.

As elements which improve the hardenability by a small amount of addition, Nb and B may be mentioned. B and Nb segregate at the austenite grain boundaries (called "γ-grain boundaries") and suppress the formation of ferrite from the grain boundaries to thereby raise the hardenability.

As a result, transformation to massive ferrite or bainite is promoted and strength is secured and also formation of film-like ferrite from the γ-grain boundaries is inhibited. Film-like ferrite forms paths for crack propagation, so if adding Nb and B to suppress the formation of film-like ferrite, the toughness is remarkably improved.

To make maximum use of this effect of B and Nb, it is necessary to reduce the amounts of C and N. By lowering the C, precipitation and growth of Nb carbides (NbC) and Fe carboborides ($Fe_{23}(CB)_6$) are suppressed. Due to this, solid solution Nb and B can be secured. Further, NbC finely precipitates, so reduction of the amount of C is also effective for improvement of the strength by precipitation strengthening.

On the other hand, when NbC excessively precipitates, the NbC is distributed at the γ-grain boundaries, the amount of grain boundary segregation of Nb relatively decreases, and the hardenability falls. Further, due to the reduction of the N, formation of nitrides of Nb (NbN) precipitating at a higher temperature than NbC can be suppressed. Further, reduction of N is also effective for suppressing the precipitation of nitrides of B (BN).

Furthermore, if dispersing fine Ti-containing oxides in the steel, the oxides can pin the crystal grains even at the peak temperature in the weld heat cycle and thereby prevent the coarsening of the grain size of the HAZ. Further, fine Ti-containing oxides act as nuclei for intragranular transformation at the HAZ. Due to the intragranular ferrite formed, coarsening of the grain size of the HAZ is further suppressed.

If the grain size of the HAZ becomes coarser, the grain boundary area will be reduced, the grain boundary concentration of B and Nb segregating at the grain boundaries will rise, and the grain boundary precipitation of carbides, nitrides, etc. will be promoted. As a result, these precipitates and the grain boundary ferrite formed using these as nuclei will aggravate grain boundary embrittlement.

To disperse fine Ti-containing oxides in the steel, when smelting the steel, it is necessary to perform preliminary deoxidation to adjust the concentration of dissolved oxygen in the molten steel to a suitable range of concentration, then add the Ti. Due to this processing, it is possible to make the density of Ti-containing oxides of a particle size of 0.05 to 10 μm, advantageous to the present invention, 30 to 300/mm$^2$.

Furthermore, the inventors discovered that just dispersing Ti-containing oxides was insufficient and that if not sufficiently suppressing the amount of oxides of a particle size over 10 μm, the coarse particles would act as starting points for impact fracture and lower the toughness of the base material and HAZ in some cases. To reduce the amount of oxides containing Ti of a particle size over 10 μm, it is necessary to perform vacuum degassing after adding the Ti.

The inventors first took note of the amount of Nb and the amount of C based on the above discoveries and considerations and studied the relationship between the yield strength and the contents of C and Nb.

Specifically, they smelted various types of steel containing, by mass %, 0.005 to 0.030% of C, 0.05 to 0.50% of Si, 0.4 to 2.0% of Mn, 0.02 to 0.25% of Nb, 0.005 to 0.025% of Ti, 0.0008 to 0.0045% of N, 0.0003 to 0.0030% of B, and 0.0005 to 0.0035% of O, limiting the amount of P to 0.030% or less and the amount of S to 0.020% or less, having a balance of Fe and unavoidable impurities, and changed in amount of C and amount of Nb in various ways, hot rolled them to produce steel plates of thicknesses of 80 to 125 mm, and tested them by tensile tests according to JIS Z 2241.

FIG. 1 shows, as a parameter of the amount of solid solution of Nb, the correspondence between C (mass %)—Nb (mass %)/7.74 on the abscissa and the yield strength (MPa) of the steel material at ordinary temperature on the ordinate. According to FIG. 1, it is learned that if lowering the C—Nb/7.74, the yield strength rises. This means that to obtain the necessary yield strength, it is necessary to secure a solid solution amount of Nb.

Further, from FIG. 1, it is learned that if lowering the C—Nb/7.74 to 0.02 or less, the yield strength becomes 350 MPa or more. Furthermore, if making the C—Nb/7.74 a value of 0.01 or less, furthermore 0.004 or less, most preferably 0.002 or less, it is possible to stably secure the yield strength.

Next, the inventors studied the effects of inclusions on the toughness. If the oxides present in the steel are coarse, they become starting points of fracture and cause the toughness to drop. The inventors discovered that to secure toughness in a high strength thick steel material, in particular, giant H-shape, it is extremely effective to add Ti, then perform vacuum degassing to reduce the coarse inclusions.

Therefore, in the present invention, to keep the coarse inclusions from remaining at a high density, it is necessary to sufficiently take the measure of preliminarily deoxidizing the steel, then adding Ti and furthermore degassing the steel to remove the coarse inclusions in the molten steel.

The inventors, based on the above discoveries and considerations, took note of the fact that in particular the drop in toughness was remarkable due to the fracture mechanism starting from coarse inclusions, revealed the standards for size for removal and distribution number density for securing toughness, and studied methods for removal of the coarse inclusions.

Specifically, the inventors took steel containing, by mass %, 0.005 to 0.030% of C, 0.05 to 0.50% of Si, 0.4 to 2.0% of Mn, 0.02 to 0.25% of Nb, 0.005 to 0.025% of Ti, 0.0008 to 0.0045% of N, 0.0003 to 0.0030% of B, and 0.0005 to 0.0035% of O, limiting the amount of P to 0.030% or less and the amount of S to 0.020% or less, and having a balance of Fe and unavoidable impurities, preliminarily deoxidized it, then added Ti and smelted and cast it while changing the vacuum degassing time so as to change the size and density of oxides containing Ti in the steel.

The inventors hot rolled each steel slab or billet to obtain steel plate of a thickness of 80 to 120 mm, sampled a small piece for evaluation of the toughness of the HAZ (weld heat affected zone), heated this by a rate of temperature elevation of 10° C./s to 1400° C., held it there for 1 second, then cooled it by a cooling speed from 800° C. to 500° C. of 15° C./s.

From each small piece heat treated to simulate the heat history of the HAZ, a V-notch test piece was taken and subjected to a Charpy impact test at 0° C. based on JIS Z 2242. Further, the fracture surface and metal structure were observed under a scan type electron microscope (SEM) and the size and density of oxides affecting the toughness were studied.

As a result, it was learned that there were inclusions of over 10 μm size at the fracture surface of a test piece remarkably fallen in toughness. Further, using an energy dispersion type X-ray device (EDX) attached to an SEM, it was learned that the inclusions of over 10 μm size were oxides containing Ti. Furthermore, from the SEM photograph of the metal structure, the density of the oxides of over 10 μm size was measured.

Figure 2:
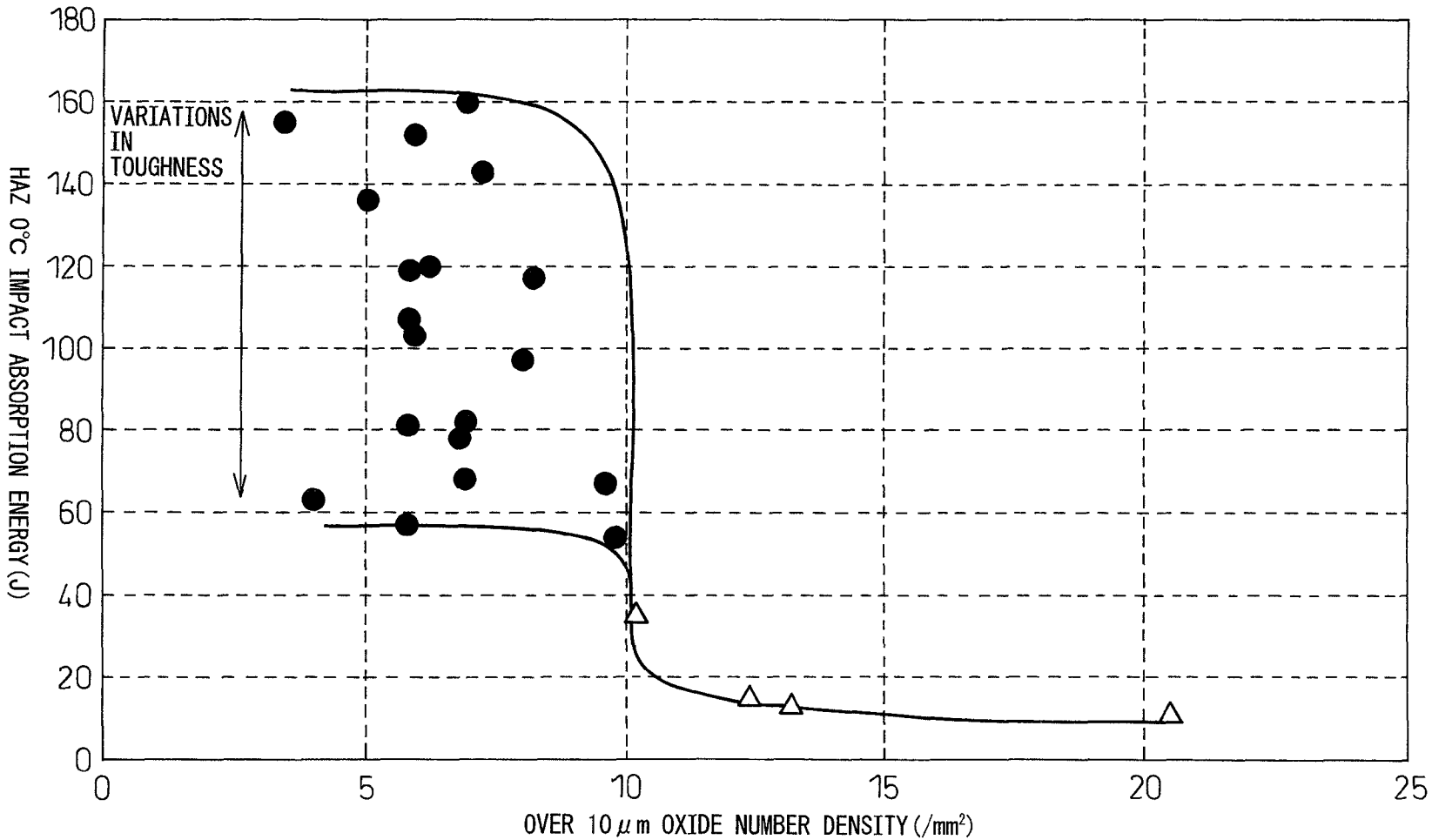
FIG. 2 is a view showing the effects of a number density of coarse oxides of a particle size of over 10 μm on a HAZ toughness of a steel material.

FIG. 2 shows the relationship between the density of oxides of over 10 μm size and the toughness. From FIG. 2, it was learned that if making the density of oxides of over 10 μm size 10/mm$^2$ or less, preferably less than 7/mm$^2$, it is possible to stably make the Charpy absorbed energy at 0° C. a value of 50 J or more.

Figure 3:
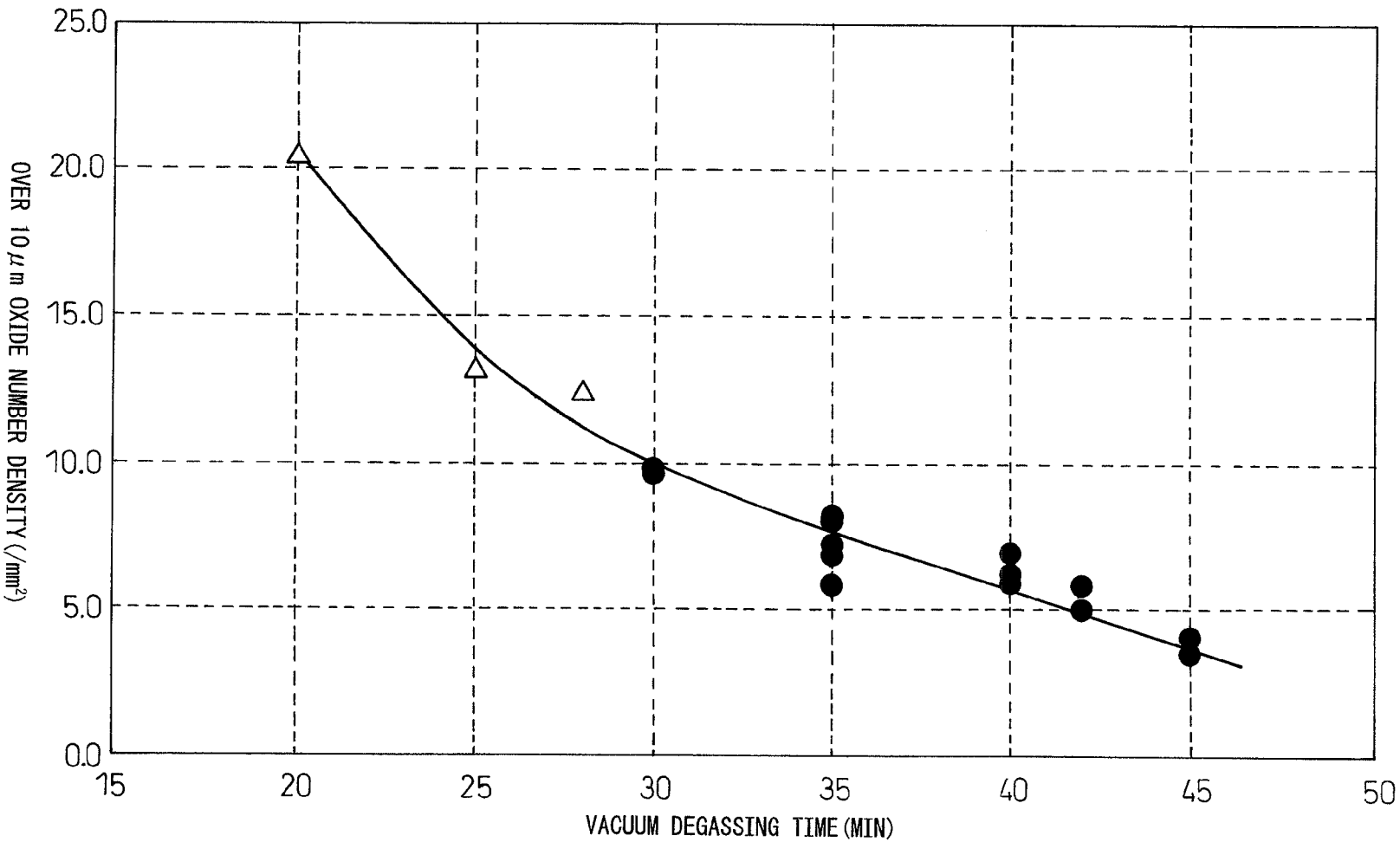
FIG. 3 is a view showing a relationship between vacuum degassing and a number density of coarse oxides of a particle size of over 10 μm.

Furthermore, the relationship between the density of oxides of over 10 μm size and the vacuum degassing time after addition of Ti is shown in FIG. 3. From FIG. 3, it was learned that to make the density of oxides of over 10 μm size a value of $10/mm^2$ or less, it is necessary to make the vacuum degassing time 30 minutes or more. Furthermore, if making the vacuum degassing time 35 minutes or more, the Ti-containing oxides of a particle size of over 10 μm can be reliably reduced to $10/mm^2$ or less. Furthermore, if making it 40 minutes or more, the oxides can be reduced to less than $7/mm^2$.

Further, if the steel material is increased in thickness, the amount of input heat in welding has to be increased. In particular, at the HAZ (weld heat affected zone), the heating to 1400° C. causes the crystal grain size to coarsen. Furthermore, rapid cooling promotes the formation of a hard phase, so there is a remarkable drop in toughness.

In the present invention, to suppress the coarsening of the grain size due to heating, fine Ti-containing oxides which will not enter into solution even if heated to 1400° C. are dispersed. The fine Ti-containing oxides have a pinning effect. Even at the peak temperature in the weld heat cycle, crystal grain growth is suppressed and coarsening of the grain size of the HAZ is prevented.

Fine oxides are also effective for refining the grain size of the steel material, not only the HAZ. In particular, in the thick steel material or giant H-shape of the present invention, it is not possible to secure the amount of working under hot rolling in the period from the material, that is, the steel slab or billet, to the production of the final product. Refinement utilizing the recrystallization due to hot working is difficult.

Therefore, the pinning effect of the crystal grain boundaries by the fine oxides, effective for refining the microstructure of the steel slab or billet as well, is extremely important. To make a large number of fine oxides disperse in the steel, in the steelmaking process for smelting the steel, suitable deoxidation and degassing must be performed and the concentration of dissolved oxygen before addition of Ti adjusted.

Below, the reasons for limitation of the composition of the thick steel material and giant H-shape of the present invention will be explained. Note that, "%" means "mass %".

C is an element forming a solid solution in the steel and contributing to the rise in strength. The lower limit of content is made 0.005%. Furthermore, when strength is demanded, addition of 0.008% or more of C is preferable. However, if excessively adding C, the weldability will be impaired. Further, if over 0.030% of C is included, island-like martensite will form between the laths of the bainite phase and the toughness of the base material will be remarkably lowered.

Therefore, the upper limit of C must be made 0.030%. Furthermore, to suppress the formation of NbC and secure the amount of solid solution Nb, the upper limit of the amount of C is preferably 0.020%.

Nb is an element which contributes to the improvement of the strength and toughness even with a small amount of addition, so is extremely important in the present invention. Nb, if present in the steel as solid solution Nb, in particular segregates together with B at the grain boundaries, whereby the hardenability is remarkably raised. To raise the ordinary temperature strength, 0.02% or more of Nb has to be added. When a higher strength is sought, addition of 0.03% or more is preferable.

On the other hand, if adding over 0.25% of Nb, the alloy cost rises, which is economically disadvantageous relative to the effect, so the upper limit was made 0.25%. Note that, when an improvement in strength is expected due to the addition of B, from the viewpoint of economy, the amount of Nb is preferably made 0.10% or less and more preferably is made 0.08% or less.

Further, Nb is a powerful carbide forming element. It immobilizes excessive C as NbC and prevents the reduction of the solid solution B due to the formation of $Fe_{23}(CB)_6$. In the present invention, as explained above, the amount of addition of Nb has to satisfy $$C—Nb/7.74 \leqq 0.02\%$$

By making it preferably 0.01% or less, furthermore 0.004%, it is possible to improve the yield ratio and other of the mechanical characteristics.

Furthermore, to secure the amount of solid solution Nb and improve the ordinary temperature strength, the mass % concentration product of Nb and C is preferably made 0.00015 or more. Note that, the mass % concentration product of Nb and C is the product of the amount of Nb [mass %] and the amount of C [mass %].

B segregates at a high temperature at the crystal grain boundaries of austenite and suppresses the ferrite transformation at the time of cooling, so with a slight amount of addition raises the hardenability and remarkably contributes to the rise in strength. To obtain this effect, addition of 0.0003% or more of B is necessary. Further, even if reducing the amount of addition of Nb, to suppress ferrite transformation from the γ-grain boundaries, prevent the formation of film-like ferrite, and improve the toughness, addition of 0.0008% or more of B is preferable. On the other hand, if adding over 0.0030% of B, BN is formed and the toughness is impaired. From the viewpoint of securing suitable hardenability, the upper limit of the amount of addition is preferably made 0.0020%.

Ti is an important element which forms oxides and contributes to the refinement of the grain size of the base material and HAZ. Further, Ti is an element which forms nitrides to immobilize the N, so suppresses the formation of BN and also contributes to the expression of the effect of improvement of the hardenability by B. In particular, to form Ti-containing oxides effective for refining the HAZ in grain size, addition of 0.005% or more of Ti is necessary. To form TiN and suppress the precipitation of BN, addition of Ti in 0.008% or more is preferable.

On the other hand, if adding over 0.025% of Ti, even if subsequently vacuum degassing, coarse Ti-containing oxides are excessively formed and the toughness is impaired. From the viewpoint of reducing the coarse Ti-containing oxides more, the upper limit is made 0.020%, more preferably 0.015%.

O, in the present invention, is an element forming fine oxides with Ti, suppressing the growth of crystal grains, and contributing to the improvement of the toughness. Such an effect can be obtained even if the amount of O contained in the steel material is a very fine amount. The amount of O should be 0.0005% or more.

Reduction of the amount of O is achieved by vacuum degassing after addition of Ti, but to suppress the production costs, the amount of O is preferably made 0.0008% or more, more preferably 0.0015% or more.

On the other hand, to suppress the formation of coarse Ti-containing oxides, after addition of Ti, it is necessary to perform vacuum degassing and make the concentration of O in the steel 0.0035% or less. From the viewpoint of further refinement of Ti-containing oxides formed, 0.0025% or less is preferable and 0.0020% or less is more preferable.

Figure 4:
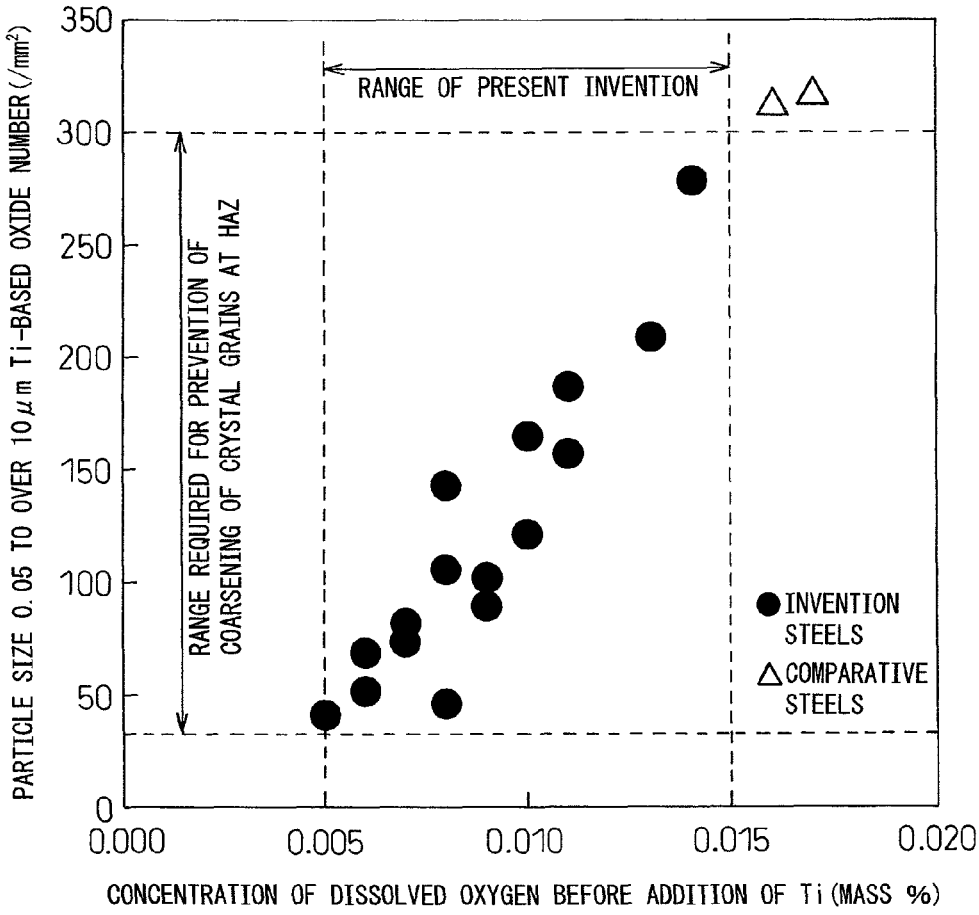
FIG. 4 is a view showing a relationship between a concentration of dissolved oxygen before addition of Ti and fine Ti-containing oxides (particle size 0.05 to 10 μm).

Furthermore, for securing a presence of Ti-containing oxides of a particle size of 0.05 to 10 μm and a density of 30 to $300/mm^2$ in the steel, the amount of dissolved oxygen before addition of Ti when smelting the steel is important. FIG. 4 shows the relationship between the concentration of dissolved oxygen in the molten steel before addition of Ti and the number of fine Ti-containing oxides of the steel after smelting (particle size 0.05 to 10 μm).

As will be understood from FIG. 4, if the amount of dissolved oxygen before adding the Ti is less than 0.005%, the Ti-based oxides become smaller in particle size and drop in density. On the other hand, if the amount of dissolved oxygen before adding the Ti is over 0.015%, the Ti-containing oxides become coarser with a particle size exceeding 10 μm and inhibit toughness. Therefore, the amount of dissolved oxygen before adding the Ti is made 0.005 to 0.015% in range.

When smelting the steel, before adding the Ti, if using Si and Mn as deoxidizing agents for deoxidation, the amount of dissolved oxygen can be made 0.005 to 0.015%.

N is an element which immobilizes the Nb and B, which contribute to the improvement of the hardenability of the steel, as nitrides NbN and BN, so the content has to be reduced to 0.0045% or less. The lower the amount of N, the more improved the toughness, so to secure the toughness, the upper limit is preferably made 0.0030%.

Note that, reducing the amount of N to less than 0.0008% would require excessive production costs, so the lower limit is preferably made 0.0008%. Further, to form TiN stably present at the HAZ, the Ti/N concentration ratio is preferably made 3.4 or more.

Si is a deoxidizing element and an element contributing to the increase in strength as well. To secure the strength of the base material and preliminarily deoxidize the molten steel, 0.05% or more of Si has to be added. However, if the amount of Si exceeds 0.50%, island-like martensite forms and the toughness of the base material is remarkably lowered.

Note that, when plating the steel to improve the corrosion resistance, if the amount of Si exceeds 0.40%, unevenness will form at the time of hot dipping and the surface properties will be impaired, so the amount is made 0.40% or less, more preferably 0.30% or less.

Mn is an element raising the hardenability. To make the metal structure bainite or massive ferrite and secure the strength and toughness of the base material, 0.4% or more has to be added. On the other hand, if over 2.0% of Mn is added, in particular, it segregates at the center of the steel slab or billet, the segregated part excessively rises in hardenability, and the toughness deteriorates.

In particular, when the amounts of the selectively added strengthening elements are small, to secure strength, 0.8% or more of Mn is preferably added. Further, to secure sufficient toughness even near the center of the plate thickness where segregation easily occurs, the upper limit of Mn is preferably made 1.7%.

P is an impurity. In particular, to suppress the drop in weldability and toughness, the upper limit is made 0.030%.

S is also an impurity. To suppress the drop in weldability and toughness and secure the hot workability, the upper limit is made 0.020%.

Note that, both P and S are preferably given lower limits of 0.005% from the viewpoint of production costs.

Next, the selectively added ingredients will be explained.

V and No are known as precipitation strengthening elements, but in the present invention, they reduce the contents of C and N, so the effect of precipitation strengthening is small. They contribute to solution strengthening.

V, like Ti and Nb, is an element forming carbide and nitrides, but in the present invention, as explained above, contributes to solution strengthening. The effect becomes saturated and economy is impaired even if over 0.1% of V is added, so the upper limit is preferably made 0.1%.

Mo is an element forming carbides, but in the present invention, as explained above, contributes to solution strengthening and, furthermore, contributes to the improvement of the hardenability. However, Mo is an expensive element. If the amount of addition exceeds 0.1%, the economy is greatly impaired, so the upper limit is preferably made 0.1%.

Al and Mg are deoxidizing elements and may be added to adjust the concentration of dissolved oxygen before the addition of Ti.

Al is a powerful deoxidizing element and, further, is an element forming nitrides. In the present invention, it may be added to control the concentration of dissolved oxygen before the addition of Ti. Further, due to the formation of AlN, it immobilizes the N and also contributes to the suppression of formation of BN.

However, due to the addition of 0.025% or more of Al, island-like martensite is formed and impairs the toughness in some cases, so the upper limit is preferably made less than 0.025%. Furthermore, to prevent a local drop in the toughness accompanying the formation of island-like martensite, the amount of Al is preferably made less than 0.010%.

Mg is a powerful deoxidizing element and forms Mg-based oxides which finely disperse in the steel. Mg-based oxides stably present at a high temperature will not form a solid solution even at the peak temperature of the weld heat cycle and have the function of pinning the γ-grains, so contribute to not only the refining of the crystal grain size of the base material, but also the refining of the structure of the HAZ, so when added, 0.0005% or more is preferably added.

However, when adding Mg to the molten steel, the Mg-based oxides are easily removed. If making the amount of Mg over 0.005%, the Mg-based oxides coarsen, so 0.005% or less is added.

Zr and Hf are elements forming nitrides. They immobilize the N in the steel and suppress the formation of NbN and BN, so when added, 0.005% or more is preferably added in each case.

Zr forms stable ZrN at a higher temperature than Ti and contributes to the reduction of the solid solution N in the steel. Compared with the case of adding Ti alone, it is possible to remarkably secure solid solution B and solid solution Nb. However, if over 0.03% of Zr is added, coarse ZrN is formed and the toughness is sometimes impaired, so the upper limit is preferably made 0.03%.

Hf, like Ti and Zr, is an element forming nitrides, but with over 0.01% of Hf added, the toughness of the HAZ sometimes falls, so the upper limit is preferably made 0.01%.

Cr, Cu, and Ni are elements which improve the hardenability and contribute to the rise in strength, so when added, 0.01% or more is preferably added. Cr and Cu, if excessively added, sometimes cause a rise in strength and impair toughness, so Cr is preferably given an upper limit of 1.5% and Cu one of 1.0%. Ni is also an element contributing to the improvement of the toughness, but even if over 1.0% is added, the effect is saturated.

Further, Cu and Ni, from the viewpoint of the production costs, are preferably made a total of 1.0% or less. From the viewpoint of economy, the more preferable upper limit of the amount of Cu is 0.5% or less and the upper limit of the amount of Ni is 0.3% or less.

REM and Ca are elements effective for control of the form of the sulfides. When added, in each case, 0.0005% or more is preferably added.

An REM (rare earth metal) is an element forming stable oxides and sulfides at a high temperature. At the time of welding, it suppresses the grain growth at the HAZ heated to a high temperature, refines the structure of the HAZ, and contributes to a drop in the toughness. However, if adding over 0.01% as a total content of all rare earth metals, the volume fraction of the oxides or sulfides becomes higher and the toughness is reduced in some cases, so the upper limit is preferably made 0.01%.

Ca forms CaS and exhibits the effect of forming MnS flattened by hot rolling in the rolling direction. Due to this, the toughness is improved. In particular, this contributes to the improvement of the Charpy impact value in the plate thickness direction. However, if over 0.005% is added, the volume fraction of the oxides or sulfides becomes higher and the toughness is reduced in some cases, so the upper limit is preferably made 0.005%.

Next, Ti-containing oxides will be explained. In the present invention, control of the particle size and density of the Ti-containing oxides is extremely important for improving the toughness by refining the crystal grains of the base material and HAZ. Further, Ti-containing oxides function as nuclei for formation of nitrides, promote the immobilization of N by TiN and other nitrides formed at a high temperature, and suppress the precipitation of NbN and BN.

As a result, the effect of improvement of hardenability by Nb and B can be exerted to the maximum extent, so the Ti-containing oxides also indirectly contribute to the improvement of strength.

In the present invention, "Ti-containing oxides" is the general term for TiO, $TiO_2$, $Ti_2O_3$, and other Ti-based oxides, complex oxides of these Ti-based oxides and oxides other than Ti-based oxides, and, furthermore, complex inclusions of these Ti-based oxides or complex oxides with sulfides. As oxides of other than Ti, $SiO_2$ and other Si-based oxides, $Al_2O_3$ and other Al-based oxides, and also Mg-based oxides, Ca-based oxides, etc. may be mentioned.

Note that, complex oxides of Ti-based oxides and Si-based oxides, Al-based oxides, Mg-based oxides, Ca-based oxides, etc. and complex inclusions of Ti-based oxides serving as nuclei for formation around which MnS or other sulfides precipitate are treated as single entities.

Ti-containing oxides can be measured for particle size and density by observing the metal structure by an SEM and using an EDX to identify the elements included in the oxides. Further, an X-ray microanalyzer (EPMA) may be used to detect the inclusions containing Ti and O, and image analysis or comparison with a structural photograph may be performed to measure the particle size and density of Ti-containing oxides.

The average particle size of about 50 particles and number density of particles in a range of 0.5 mm×0.5 mm or a greater field were found. Note that, the particle size of the Ti-containing oxides is the largest diameter in a photograph of the structure.

Ti-containing oxides of a particle size of 0.05 μm to 10 μm, as explained above, pin the crystal grain boundaries to retard grain growth and contribute to the refinement of the crystal grains of the base material and HAZ. If the particle size of the Ti-containing oxides is less than 0.05 μm, no pinning effect can be obtained, but this does not particularly become a cause for reduction of the toughness.

On the other hand, if the particle size of the Ti-containing oxides is over 10 μm, as explained above, these will form starting points of fracture, while if the density is over $10/mm^2$, the base material and HAZ will fall in toughness.

Therefore, to improve the HAZ toughness, it is necessary to make the density of Ti-containing oxides of a particle size of 0.05 to 10 μm $30/mm^2$ or more. On the other hand, if the density of the Ti-containing oxides of a particle size of 0.05 to 10 μm is over $300/mm^2$, these will form paths for the progression of cracks, so the toughness will fall.

If the thickness of the steel material is less than 40 mm, the grade of the steel material by hot rolling can be controlled relatively easily. Therefore, the present invention can be advantageously applied to a steel material of a thickness of 40 mm or more.

However, with a thick steel material of a thickness of over 150 mm, even if applying the present invention, sometimes it is difficult to secure the toughness.

Note that, in the case of an H-beam, if the flange thickness becomes 40 mm or more, it is called an "giant H-shape". The present invention can be particularly advantageously applied to this. This is because when producing an giant H-shape from a slab or billet or beam flange shape material, the amount of work at not only the flange, but also the fillet (portion where flange and web are connected) is limited, so it is more difficult to secure strength and toughness compared even with the case of producing a thick steel material. Note that, even in the case of an H-beam, if the flange thickness is over 150 mm, even if the present invention is applied, securing the toughness is sometimes difficult.

The target values of the mechanical properties when using an giant H-shape as a structural member are an ordinary temperature yield point or 0.2% yield strength of 450 MPa or more and a tensile strength of 550 MPa or more (equivalent to ASTM standard grade 65). Furthermore, preferably, the ordinary temperature yield point or 0.2% yield strength is 345 MPa or more and the tensile strength is 450 MPa or more (equivalent to ASTM standard grade 50).

Further, the Charpy impact absorbed energy at 0° C. is 47 J or more at the base material and 47 J or more at the HAZ.

Next, the method of production will be explained.

In the present invention, to cause the formation of fine Ti-containing oxides and suppress the formation of coarse Ti-containing oxides, the steelmaking process for smelting the steel is extremely important. In particular, the deoxidation is important. It is necessary to control the amount of dissolved oxygen before the addition of Ti to a suitable range and perform vacuum degassing after the addition of Ti under suitable conditions.

First, to form fine Ti-containing oxides, it is important to control the amount of dissolved oxygen before the addition of Ti. The amount of dissolved oxygen before addition of Ti can be controlled by the amounts of addition of the Si, Mn, and other deoxidizing elements and the amounts of the selectively added Al and Mg. If the dissolved oxygen before addition of Ti is, by mass %, less than 0.005%, the amount of formation of Ti-containing oxides of a particle size of 10 μm or less will become insufficient.

On the other hand, if the dissolved oxygen before addition of Ti is over 0.015%, the coarse Ti-containing oxides of a particle size of over 10 μm will increase and, at the subsequent vacuum degassing, the treatment time required for sufficiently reducing the coarse oxides will become longer. Therefore, not only will the production costs rise, but also the density of Ti-containing oxides of a particle size of 10 μm or less will fall.

In the steelmaking process, as explained above, Ti is added under suitable conditions, the chemical composition of the molten steel is adjusted, then vacuum degassing is performed. As explained above, to make the density of Ti-containing particles of a particle size of 10 μm or less $10/mm^2$ or less, the time for vacuum degassing has to be made 30 minutes or more. Further, to efficiently reduce the coarse Ti-containing oxides, the vacuum degree in the vacuum degassing is preferably made 5 Torr or less.

Furthermore, to improve the toughness, vacuum degassing is preferably performed with a vacuum degree of 5 Torr or less for 35 minutes or more, more preferably 40 minutes or more. Note that, the upper limit of the treatment time is preferably 60 minutes or less so as to keep down the rise in the production costs.

After the steel is smelted, it is cast to obtain a steel slab or billet. The casting is, from the viewpoint of productivity, preferably continuous casting. Further, the thickness of the steel slab or billet, from the viewpoint of the productivity, is preferably 200 mm or more. If considering the reduction of the segregation, homogeneity of the heating temperature in the hot rolling, etc., 350 mm or less is preferable.

Next, the steel slab or billet is heated and hot rolled. The heating temperature of the steel slab or billet is made 1100 to 1350° C. in range. If the heating temperature is less than 1100° C., the deformation resistance becomes higher. In particular, the heating temperature when producing an H-beam is preferably 1200° C. or more for facilitating plastic deformation compared with when producing steel plate.

On the other hand, when the heating temperature is a temperature higher than 1350° C., the scale at the surface of the material, that is, the steel slab or billet, liquefies and damages the inside of the furnace, so the economic merits end up becoming leaner. For this reason, the upper limit of the heating temperature in hot working is made 1350° C.

In hot rolling, rolling so that the cumulative reduction rate at 1000° C. or less becomes 10% or more is preferable. This is because, hot rolling promotes working recrystallization, refines the austenite, and improves the toughness and strength. Note that, it is also possible to roughly roll the steel before the hot rolling in accordance with the thickness of the steel slab or billet and the thickness of the product.

When hot rolling, then cooling, the average cooling speed in the 800° C. to 500° C. temperature range is preferably made 0.1 to 10° C./s. Due to the accelerated cooling, the austenite transforms to the hard and superior toughness bainite or bainitic ferrite and the strength and toughness can be improved.

If the average cooling speed is made 0.1° C./s or more, it is possible to obtain the effect of accelerated cooling. On the other hand, if the average cooling speed exceeds 10° C./s, the structural fraction of the bainite phase or martensite phase rises and the toughness sometimes falls.

The average cooling speed in the 800° C. to 500° C. temperature range can be found by the time required for cooling from 800° C. to 500° C. Note that, the accelerated cooling may be started after the hot rolling, in the case of the later explained 2-heat rolling, after the end of the secondary rolling, at a 800° C. or more temperature. On the other hand, the stop temperature of the accelerated cooling need only be 500° C. or less and is not particularly limited.

Note that, for the hot rolling, a process of performing primary rolling once to the middle, cooling to 500° C. or less, then again heating to 1100 to 1350° C. and performing secondary rolling, that is, 2-heat rolling, may be employed. With 2-heat rolling, there is little plastic deformation in the hot rolling and the drop in temperature in the rolling process also becomes smaller, so the heating temperature can be made lower. Therefore, in hot rolling of an H-beam, 2-heat rolling is preferably employed.

EXAMPLES

Steel of each of the chemical compositions shown in Table 1 was smelted and continuously cast to produce a steel slab or billet of a thickness of 240 to 300 mm. The steel was smelted by a converter, treated by primary deoxidization, given alloy elements, adjusted in concentration of dissolved oxygen as shown in Table 2, treated by Ti deoxidation, and then, furthermore, vacuum degassed.

TABLE 1

| Steel | Composition (mass %) | | | | | | | | | | |
|---|---|---|---|---|---|---|---|---|---|---|---|
| No. | C | Si | Mn | P | S | Nb | N | B | Ti | O | V, Mo |
| A | 0.007 | 0.30 | 1.56 | 0.009 | 0.007 | 0.04 | 0.0025 | 0.0012 | 0.020 | 0.0016 | |
| B | 0.010 | 0.25 | 1.58 | 0.008 | 0.007 | 0.06 | 0.0022 | 0.0013 | 0.018 | 0.0015 | |
| C | 0.024 | 0.50 | 1.78 | 0.008 | 0.008 | 0.18 | 0.0023 | 0.0010 | 0.025 | 0.0021 | |
| D | 0.005 | 0.20 | 1.56 | 0.008 | 0.010 | 0.03 | 0.0027 | 0.0013 | 0.015 | 0.0013 | 0.05V |
| E | 0.011 | 0.30 | 1.44 | 0.009 | 0.007 | 0.06 | 0.0042 | 0.0015 | 0.016 | 0.0021 | 0.05V, 0.06Mo |
| F | 0.010 | 0.25 | 1.60 | 0.010 | 0.008 | 0.05 | 0.0028 | 0.0013 | 0.020 | 0.0025 | |
| G | 0.007 | 0.20 | 0.90 | 0.012 | 0.007 | 0.05 | 0.0024 | 0.0012 | 0.022 | 0.0024 | |
| H | 0.008 | 0.20 | 0.70 | 0.012 | 0.007 | 0.04 | 0.0024 | 0.0008 | 0.018 | 0.0024 | |
| I | 0.005 | 0.35 | 1.30 | 0.016 | 0.011 | 0.04 | 0.0023 | 0.0015 | 0.020 | 0.0022 | 0.1V |
| J | 0.006 | 0.25 | 1.48 | 0.010 | 0.012 | 0.05 | 0.0018 | 0.0010 | 0.014 | 0.0019 | 0.06V |
| K | 0.009 | 0.20 | 1.55 | 0.009 | 0.008 | 0.06 | 0.0023 | 0.0011 | 0.006 | 0.0024 | 0.08Mo |
| L | 0.007 | 0.30 | 1.60 | 0.008 | 0.010 | 0.04 | 0.0019 | 0.0010 | 0.012 | 0.0023 | |
| M | 0.010 | 0.25 | 1.50 | 0.009 | 0.009 | 0.05 | 0.0020 | 0.0015 | 0.021 | 0.0025 | 0.05V |
| N | 0.006 | 0.30 | 1.68 | 0.006 | 0.007 | 0.04 | 0.0018 | 0.0009 | 0.020 | 0.0016 | 0.05V, 0.06Mo |
| O | 0.005 | 0.30 | 1.89 | 0.006 | 0.007 | 0.03 | 0.0018 | 0.0009 | 0.020 | 0.0016 | |
| P | 0.007 | 0.25 | 1.55 | 0.008 | 0.006 | 0.03 | 0.0022 | 0.0010 | 0.015 | 0.0023 | 0.05V |
| Q | 0.025 | 0.35 | 1.55 | 0.010 | 0.015 | 0.04 | 0.0031 | 0.0020 | 0.015 | 0.0011 | 0.06V, 0.06Mo |
| R | 0.020 | 0.35 | 1.60 | 0.009 | 0.013 | 0.03 | 0.0020 | 0.0018 | 0.018 | 0.0013 | 0.05V, 0.1Mo |
| AA | 0.031 | 0.35 | 1.30 | 0.012 | 0.008 | 0.02 | 0.0027 | 0.0011 | 0.020 | 0.0025 | |
| AB | 0.008 | 0.50 | 1.55 | 0.009 | 0.007 | 0.04 | 0.0035 | 0.0009 | 0.018 | 0.0029 | |
| AC | 0.031 | 0.40 | 1.61 | 0.013 | 0.004 | 0.06 | 0.0026 | 0.0012 | 0.020 | 0.0013 | 0.05V |
| AD | 0.008 | 0.30 | 2.50 | 0.013 | 0.010 | 0.05 | 0.0040 | 0.0015 | 0.020 | 0.0035 | |
| AE | 0.007 | 0.35 | 1.55 | 0.012 | 0.012 | 0.04 | 0.0029 | 0.0011 | 0.019 | 0.0034 | 0.06V |
| AF | 0.021 | 0.30 | 1.46 | 0.015 | 0.008 | 0.05 | 0.0050 | 0.0006 | 0.021 | 0.0019 | 0.04V |
| AG | 0.003 | 0.25 | 1.11 | 0.008 | 0.009 | 0.02 | 0.0028 | 0.0025 | 0.015 | 0.0033 | |
| AH | 0.010 | 0.55 | 1.68 | 0.009 | 0.011 | 0.01 | 0.0023 | 0.0008 | 0.005 | 0.0016 | |
| AI | 0.015 | 0.25 | 1.34 | 0.011 | 0.012 | 0.27 | 0.0022 | 0.0011 | 0.020 | 0.0024 | 0.1Mo |
| AJ | 0.008 | 0.20 | 0.38 | 0.009 | 0.008 | 0.04 | 0.0029 | 0.0010 | 0.017 | 0.0022 | |

TABLE 1-continued

| Steel No. | Composition (mass %) Zr, Hf | Cr, Cu, Ni | Mg, Al, REM, Ca | C—Nb/7.74 | Remark |
|---|---|---|---|---|---|
| A | | | | 0.0018 | Inv. |
| B | | | | 0.0022 | steel |
| C | | | | 0.0007 | |
| D | | | | 0.0011 | |
| E | 0.008Zr | | | 0.0032 | |
| F | 0.01Hf | | | 0.0035 | |
| G | 0.01Hf | 1.0Cr, 1.0Cu | | 0.0005 | |
| H | | 1.5Cr, 1.0Cu, 0.5Ni | | 0.0028 | |
| I | | 0.8Cu, 0.6Ni | | −0.0002 | |
| J | | | 0.003Mg | −0.0005 | |
| K | | 0.5Cr, 0.3Cu | 0.02Al | 0.0012 | |
| L | | 0.5Cu, 0.3Ni | 0.002Mg, 0.003Ca | 0.0018 | |
| M | | | 0.01Al, 0.005REM | 0.0035 | |
| N | | 0.3Cu, 0.2Ni | | 0.0008 | |
| O | | | 0.02Al | 0.0011 | |
| P | | | | 0.0031 | |
| Q | | 0.3Cu, 0.2Ni | | 0.0198 | |
| R | | 0.5Cu, 0.3Ni | | 0.0161 | |
| AA | | | | 0.0284 | Comp. |
| AB | 0.01Zr | | | 0.0028 | steel |
| AC | | | | 0.0232 | |
| AD | | | 0.01Al | 0.0015 | |
| AE | | | 0.02Al | 0.0018 | |
| AF | | 0.5Cu, 0.3Ni | | 0.0145 | |
| AG | | 1.0Cu, 0.7Ni | | 0.0004 | |
| AH | | 0.3Cu, 0.2Ni | | 0.0087 | |
| AI | | | 0.02Al | −0.0199 | |
| AJ | | 1.5Cr, 1.0Cu, 0.5Ni | 0.02Al | 0.0028 | |

TABLE 2

(Continuation of Table 1)

| Steel No. | Dissolved oxygen concentration before addition of Ti (mass %) | Vacuum degassing Vacuum (Torr) | Vacuum degassing Processing time (min) | Density of Ti-based oxides (/mm$^2$) Particle size: 0.05 to 10 μm | Density of Ti-based oxides (/mm$^2$) Particle size: over 10 μm | Remark |
|---|---|---|---|---|---|---|
| A | 0.006 | 6 | 35 | 69 | 8.2 | Inv. |
| B | 0.011 | 6 | 40 | 157 | 6.9 | steel |
| C | 0.009 | 7 | 30 | 102 | 9.8 | |
| D | 0.013 | 5 | 35 | 209 | 7.2 | |
| E | 0.005 | 6 | 42 | 41 | 5.8 | |
| F | 0.007 | 5 | 40 | 82 | 6.2 | |
| G | 0.010 | 6 | 35 | 121 | 6.8 | |
| H | 0.008 | 6 | 45 | 46 | 3.4 | |
| I | 0.009 | 7 | 35 | 89 | 6.9 | |
| J | 0.008 | 5 | 40 | 143 | 5.9 | |
| K | 0.011 | 6 | 42 | 187 | 5.8 | |
| L | 0.014 | 7 | 45 | 278 | 4.0 | |
| M | 0.007 | 7 | 40 | 74 | 5.9 | |
| N | 0.006 | 5 | 42 | 52 | 5.0 | |
| O | 0.008 | 6 | 30 | 106 | 9.6 | |
| P | 0.010 | 6 | 35 | 165 | 8.0 | |
| Q | 0.009 | 7 | 40 | 123 | 6.9 | |
| R | 0.011 | 7 | 35 | 134 | 5.8 | |
| AA | 0.010 | 6 | 40 | 114 | 7.1 | Comp. |
| AB | 0.017 | 5 | 30 | 319 | 10.2 | steel |
| AC | 0.006 | 7 | 35 | 77 | 8.2 | |
| AD | 0.011 | 6 | 25 | 169 | 13.2 | |
| AE | 0.009 | 6 | 20 | 256 | 20.5 | |
| AF | 0.012 | 7 | 40 | 189 | 6.9 | |
| AG | 0.016 | 5 | 28 | 314 | 12.4 | |
| AH | 0.009 | 6 | 40 | 121 | 7.3 | |
| AI | 0.006 | 5 | 35 | 71 | 8.1 | |
| AJ | 0.009 | 6 | 40 | 108 | 7.6 | |

Figure 5:
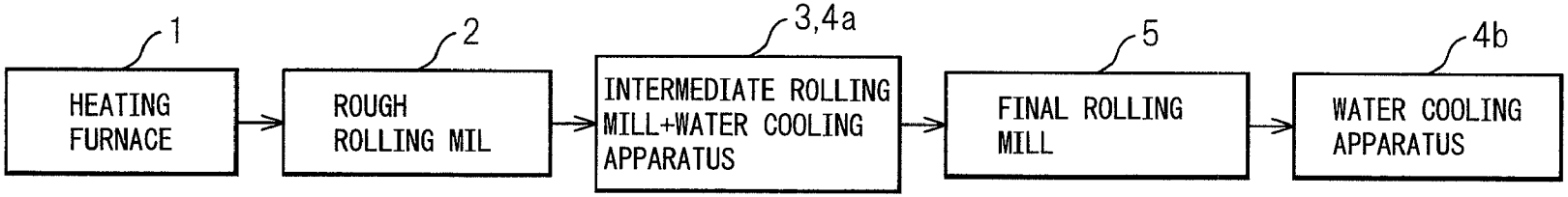
FIG. 5 is a view showing an outline of a process for production of steel shapes as an example of the facilities for working the method of the present invention.
Figure 6:
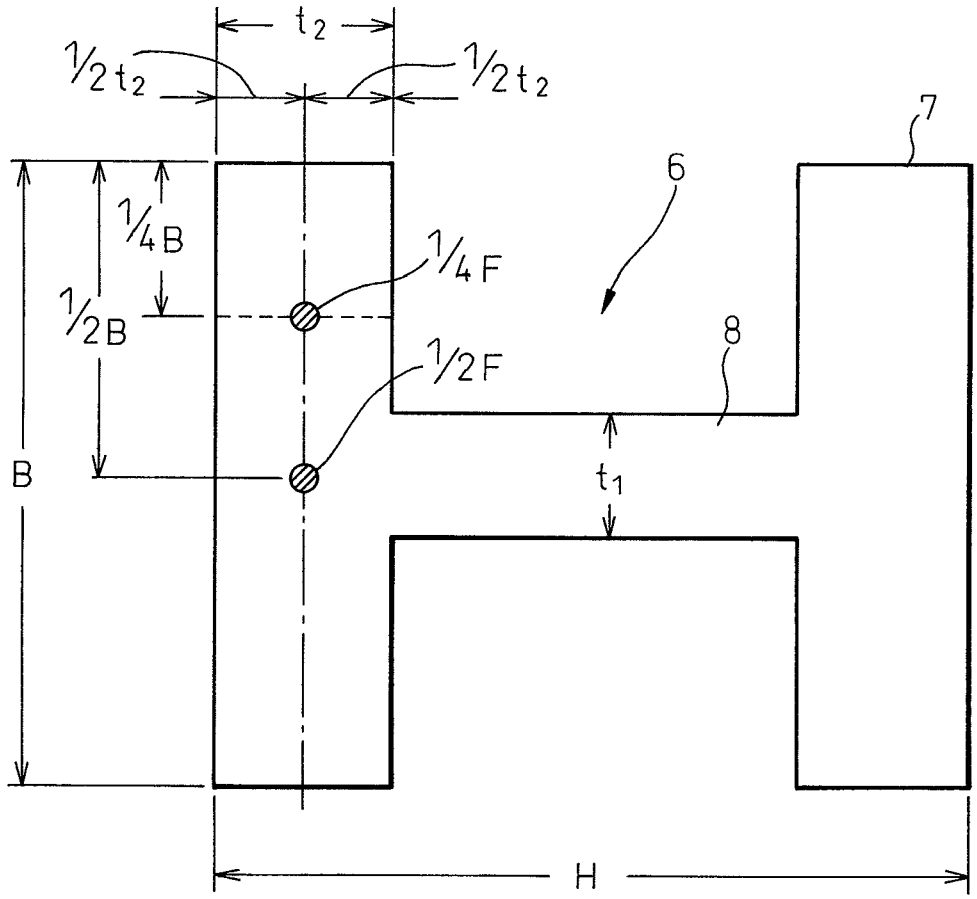
FIG. 6 is a view showing the cross-sectional shape of an H-beam and a location for taking a mechanical test piece.

*For the above, in each case, the average value of the results of observation of five fields of 1 mm$^2$ regions employed.
0.05 to 10 μm: first decimal place rounded off
Over 10 μm: second decimal place rounded off The obtained steel slab or billet was processed by the production process shown in outline in FIG. 5 to obtain an H-beam 6 such as shown in FIG. 6. That is, the steel slab or billet was heated by a heating furnace 1, roughly rolled by a roughing mill 2, then hot rolled by a universal rolling facility comprised of an intermediate rolling mill 3 and finishing mill 5 to produce an H-beam.

For the water cooling between rolling passes, water cooling apparatuses 4*a* provided before and after the intermediate universal rolling mill 3 were used. Repeated spray cooling at the outside surface of the flange and reverse rolling were performed. The accelerated cooling after hot rolling was performed, after ending the rolling at the final universal rolling mill 8, by using a cooling apparatus 4*b* provided at the rear so as to water cool the outside surface of the flange 7.

Note that, for some steels, the hot rolling was stopped in the middle, the steel cooled once, then reheated and the remaining rolling and, if necessary, cooling control by water cooling then performed (below, this process called "2-heat rolling").

To measure the mechanical characteristics, a test piece was taken from the flange 7 shown in FIG. 6 at the center of the plate thickness $t_2$ (½$t_2$) at ¼ of the total length of the flange width (B) (¼B) and measured for various mechanical characteristics. Note that, the characteristics at this location were found to because it was judged that the flange ¼F part exhibits the average mechanical characteristics of an H-beam.

The tensile test was performed based on JIS Z 2241, while the Charpy impact test was performed at 0° C. based on JIS Z 2242. Further, the HAZ toughness was evaluated by welding by a welding input heat of about 40000 J/cm and obtaining a test piece from the HAZ.

The production conditions and test results are shown in Tables 3 to 6. Table 4 and Table 5 respectively show the mechanical characteristics when changing the rolling rate in hot rolling and the accelerated cooling conditions after the end of rolling, while Table 6 shows the mechanical characteristics comparing the presence or absence of 2-heat rolling.

The target values of the mechanical characteristics are an ordinary temperature yield point or 0.2% yield strength of 450 MPa or more, a tensile strength of 550 MPa or more (equivalent to ASTM standard grade 65), or ordinary temperature yield point or 0.2% yield strength of 345 MPa or more, a tensile strength of 450 MPa or more (equivalent to ASTM standard grade 50), and Charpy impact absorbed energy at 0° C. of 47 J or more at the base material and 47 J or more at the HAZ.

As shown in Tables 3 to 6, the Steels 1 to 19 and 30 to 39 of the present invention had ordinary temperature yield points or 0.2% yield strengths satisfying the target lower limit values of 450 MPa or 345 MPa and had tensile strengths satisfying the target 550 MPa or more or 450 MPa or more. Furthermore, the Charpy impact absorbed energy at 0° C. is 47 J or more at the base material and 47 J or more at the HAZ, so the targets are sufficiently satisfied.

On the other hand, the Steels 20 to 29 of the comparative examples could not give the necessary characteristics since the underlined ingredients were outside the scope prescribed in the present invention.

TABLE 3

| Production No. | Steel No | Strength class or remark | Heating temp. (° C.) | 1000° C. or less cumulative reduction rate (%) | 800-500° C. average cooling rate (° C./s) | Flange thickness (mm) |
|---|---|---|---|---|---|---|
| 1 | A | Grade 50 & 65 | 1300 | 23% | Natural cooling | 80 |
| 2 | B | Grade 50 & 65 | | 17% | (0.05 to | 100 |
| 3 | C | Grade 50 & 65 | | 23% | 0.5° C./s) | 80 |
| 4 | D | Grade 50 & 65 | | 17% | | 100 |
| 5 | E | Grade 50 & 65 | | 37% | | 40 |
| 6 | E | Grade 50 | | 17% | | 100 |
| 7 | F | Grade 50 & 65 | | 23% | | 80 |
| 8 | G | Grade 50 & 65 | | 17% | | 100 |
| 9 | H | Grade 50 & 65 | | 37% | | 40 |
| 10 | I | Grade 50 & 65 | | 23% | | 80 |
| 11 | J | Grade 50 & 65 | | 17% | | 100 |
| 12 | K | Grade 50 & 65 | | 9% | | 125 |
| 13 | L | Grade 50 & 65 | | 9% | | 125 |
| 14 | M | Grade 50 & 65 | | 17% | | 100 |
| 15 | N | Grade 50 & 65 | | 20% | | 90 |
| 16 | O | Grade 50 & 65 | | 20% | | 90 |
| 17 | P | Grade 50 & 65 | | 17% | | 100 |
| 18 | Q | Grade 50 & 65 | | 9% | | 125 |
| 19 | R | Grade 50 & 65 | | 9% | | 125 |
| 20 | AA | Grade 50 unsuitable | 1300 | 17% | Natural cooling | 100 |
| 21 | AB | Toughness unsuitable | | 18% | (0.05 to | 100 |
| 22 | AC | Grade 50 unsuitable | | 9% | 0.5° C./s) | 125 |
| 23 | AD | Toughness unsuitable | | 20% | | 90 |
| 24 | AE | Toughness unsuitable | | 23% | | 80 |
| 25 | AF | Grade 50 unsuitable | | 17% | | 100 |
| 26 | AG | Toughness unsuitable | | 23% | | 80 |
| 27 | AH | Grade 65 unsuitable<br>Toughness unsuitable | | 20% | | 90 |
| 28 | AI | Toughness unsuitable | | 23% | | 80 |
| 29 | AJ | Grade 50 unsuitable | | 23% | | 125 |

TABLE 3-continued

| Production No. | Steel No | Base material tensile characteristics: Yield strength YP (MPa) | Tensile strength TS (MPa) | Yield ratio YP/TS | Impact characteristics (0° C. impact absorbed energy): Base material (J) *1 | HAZ (J) *2 | Remark |
|---|---|---|---|---|---|---|---|
| 1 | A | 471 | 607 | 0.78 | 321 | 117 | Inv. |
| 2 | B | 467 | 602 | 0.78 | 356 | 160 | steel |
| 3 | C | 482 | 615 | 0.78 | 158 | 54 | |
| 4 | D | 478 | 622 | 0.77 | 346 | 143 | |
| 5 | E | 466 | 598 | 0.78 | 311 | 107 | |
| 6 | E | 391 | 510 | 0.77 | 158 | 119 | |
| 7 | F | 473 | 621 | 0.76 | 356 | 120 | |
| 8 | G | 482 | 615 | 0.78 | 389 | 78 | |
| 9 | H | 492 | 618 | 0.80 | 402 | 155 | |
| 10 | I | 480 | 616 | 0.78 | 397 | 82 | |
| 11 | J | 462 | 601 | 0.77 | 367 | 103 | |
| 12 | K | 466 | 588 | 0.79 | 138 | 57 | |
| 13 | L | 464 | 591 | 0.79 | 175 | 63 | |
| 14 | M | 471 | 603 | 0.78 | 278 | 152 | |
| 15 | N | 486 | 611 | 0.80 | 339 | 136 | |
| 16 | O | 464 | 599 | 0.77 | 356 | 67 | |
| 17 | P | 470 | 603 | 0.78 | 368 | 97 | |
| 18 | Q | 455 | 569 | 0.80 | 196 | 68 | |
| 19 | R | 468 | 576 | 0.81 | 236 | 81 | |
| 20 | AA | 335 | 448 | 0.75 | 306 | 101 | Comp. |
| 21 | AB | 478 | 615 | 0.78 | 106 | 36 | steel |
| 22 | AC | 334 | 431 | 0.77 | 102 | 51 | |
| 23 | AD | 524 | 656 | 0.80 | 51 | 14 | |
| 24 | AE | 468 | 606 | 0.77 | 22 | 12 | |
| 25 | AF | 339 | 452 | 0.75 | 274 | 87 | |
| 26 | AG | 448 | 570 | 0.79 | 64 | 16 | |
| 27 | AH | 447 | 579 | 0.77 | 221 | 45 | |
| 28 | AI | 512 | 652 | 0.79 | 12 | 10 | |
| 29 | AJ | 339 | 443 | 0.77 | 309 | 125 | |

* Grade 65 specification: YP: 450 MPa or more, TS: 550 MPa or more
Grade 50 specification: YP: 345 MPa or more, TS: 450 MPa or more
*1. 3 point average, target: 47 J or more
*2. 3 point average, target: 47 J or more

TABLE 4

| Production No. | Steel No | Strength class | 1000° C. or less: cumulative reduction rate (%) | Flange thickness (mm) | Ordinary temperature mechanical characteristics: Yield strength YP (MPa) | Tensile strength TS (MPa) | Yield ratio YP/TS | Impact characteristics (0° C. impact absorbed energy): Base material (J) *1 | HAZ (J) *2 | Remark |
|---|---|---|---|---|---|---|---|---|---|---|
| 30 | D | Grade 50 & 65 | 24% | 100 | 478 | 622 | 0.77 | 211 | 143 | Inv. |
| 4 | | | 17% | | 461 | 618 | 0.75 | 243 | 138 | |
| 31 | | | 10% | | 452 | 609 | 0.74 | 298 | 139 | |
| 32 | N | Grade 50 &65 | 30% | 90 | 495 | 623 | 0.79 | 201 | 145 | |
| 15 | | | 20% | | 486 | 611 | 0.80 | 154 | 136 | |
| 33 | | | 10% | | 461 | 601 | 0.77 | 276 | 129 | |

* Grade 65 specification: YP: 450 MPa or more, TS: 550 MPa or more
Grade 50 specification: YP: 345 MPa or more, TS: 450 MPa or more
*1 3 point average Target: 47 J or more
*2 3 point average Target: 47 J or more

TABLE 5

| Production No. | Steel No | Strength class | 800-500° C.: average cooling speed (° C./s) | Flange thickness (mm) | Ordinary temperature mechanical characteristics: Yield strength YP (MPa) | Tensile strength TS (MPa) | Yield ratio YP/TS | Impact characteristics (0° C. impact absorbed energy): Base material (J) *1 | HAZ (J) *2 | Remark |
|---|---|---|---|---|---|---|---|---|---|---|
| 6 | E | Grade 50 | 0.11 | 100 | 391 | 510 | 0.77 | 158 | 119 | Inv. |
| 34 | | | 0.3 | | 405 | 534 | 0.76 | 222 | 132 | |
| 35 | | | 0.5 | | 411 | 544 | 0.76 | 241 | 145 | |

TABLE 5-continued

| Production No. | Steel No | Strength class | 800-500° C. average cooling speed (° C./s) | Flange thickness (mm) | Ordinary temperature mechanical characteristics Yield strength YP (MPa) | Tensile strength TS (MPa) | Yield ratio YP/TS | Impact characteristics (0° C. impact absorbed energy) Base material (J) *1 | HAZ (J) *2 | Remark |
|---|---|---|---|---|---|---|---|---|---|---|
| 15 | N | Grade 50 & 65 | 0.12 | 90 | 486 | 611 | 0.80 | 216 | 136 | |
| 36 | | | 0.4 | | 491 | 623 | 0.79 | 298 | 147 | |
| 37 | | | 0.6 | | 498 | 639 | 0.78 | 311 | 139 | |

* Grade 65 specification: YP: 450 MPa or more, TS: 550 MPa or more
Grade 50 specification: YP: 345 MPa or more, TS: 450 MPa or more
*1 3 point average Target: 47 J or more
*2 3 point average Target: 47 J or more

TABLE 6

| Production No. | Steel No | Strength class | Heating temperature at time of 2-heat rolling (° C.) | Flange thickness (mm) | Ordinary temperature mechanical characteristics Yield strength YP (MPa) | Tensile strength TS (MPa) | Yield ratio YP/TS | Impact characteristics (0° C. impact absorbed energy) Base material (J) *1 | HAZ (J) *2 | Remarks |
|---|---|---|---|---|---|---|---|---|---|---|
| 12 | K | Grade 50 & 65 | (*no 2 heats) | 125 | 466 | 588 | 0.79 | 138 | 57 | Inv. |
| 38 | | | 1300 | | 472 | 601 | 0.79 | 151 | 60 | |
| 13 | L | Grade 50 &65 | (*no 2 heats) | 125 | 464 | 591 | 0.79 | 175 | 63 | |
| 39 | | | 1300 | | 469 | 599 | 0.78 | 203 | 65 | |

*Grade 65 specification: YP: 450 MPa or more, TS: 550 MPa or more
Grade 50 specification: YP: 345 MPa or more, TS: 450 MPa or more
*1 3 point average Target: 47 J or more
*2 3 point average Target: 47 J or more Industrial Applicability According to the present invention, it becomes possible to produce a high strength thick steel material excellent in toughness and weldability, in particular, a high strength giant H-shape, as rolled without application of heat treatment for thermal refining after rolling and possible to reduce the installation costs, shorten the work period, and thereby greatly slash costs. Accordingly, the present invention is an extremely remarkable contribution in industry in terms of improving the reliability of large-sized buildings, securing safety, improving economy, etc.

The invention claimed is:

1. A high strength thick steel material excellent in toughness and weldability characterized by containing, by mass %, C: 0.005% to 0.030%,
Si: 0.05% to 0.50%,
Mn: 0.4% to 2.0%,
Nb: 0.02% to 0.25%,
Ti: 0.005% to 0.025%,
B: 0.0003% to 0.0030%, and
O: 0.0005% to 0.0035%, limited to P: 0.030% or less,
S: 0.020% or less, and
N: 0.0045% or less, and having a balance of Fe and unavoidable impurities,
having contents of C and Nb satisfying $$C—Nb/7.74 \leqq 0.02,$$

having a density of Ti-containing oxides of a particle size of 0.05 to 10 μm of 30 to 300 /mm$^2$, and
having a density of Ti-containing oxides of a particle size over 10 μm of 10 /mm$^2$ or less.

2. A high strength thick steel material excellent in toughness and weldability as set forth in claim 1 characterized by further containing, by mass%, one or both of:

V: 0.1% or less and
Mo: 0.1% or less.

3. A high strength thick steel material excellent in toughness and weldability as set forth in claim 1 or 2 characterized by further containing, by mass%, one or both of Al: less than 0.025% and
Mg: 0.005% or less.

4. A high strength thick steel material excellent in toughness and weldability as set forth in claim 1 characterized by further containing, by mass%, one or both of Zr: 0.03% or less and
Hf: 0.01% or less.

5. A high strength thick steel material excellent in toughness and weldability as set forth in claim 1 characterized by further containing, by mass%, one or more of Cr: 1.5% or less,
Cu: 1.0% or less, and
Ni: 1.0% or less.

6. A high strength thick steel material excellent in toughness and weldability as set forth in claim 1 characterized by further containing, by mass%, one or both of REM: 0.01% or less and
Ca: 0.005% or less.

7. A high strength thick steel material excellent in toughness and weldability as set forth in claim 1 characterized in that a product of mass % contents of Nb and C is 0.00015 or more.

8. A high strength giant H-shape excellent in toughness and weldability characterized by comprising a high strength thick steel material excellent in toughness and weldability as set forth in claim 1 and having a flange thickness of 40 mm or more.

9. A high strength giant H-shape excellent in toughness and weldability as set forth in claim 8 characterized in that said high strength giant H-shape has a yield strength of 450 MPa or more, a tensile strength of 550 MPa or more, and a Charpy absorbed energy at 0° C. of a value of 47J or more.

10. A method of production of a high strength thick steel material excellent in toughness and weldability as set forth in claim 1, said method of production characterized by smelting steel comprised of a composition of ingredients of claim 1 during which performing preliminary deoxidation to adjust the dissolved oxygen to 0.005 to 0.015 mass %, then adding Ti, furthermore vacuum degassing for 30 minutes or more for smelting, after smelting, continuously casting to produce a steel slab or billet, heating the steel slab or billet to 1100 to 1350° C., then hot rolling the steel slab or billet, then cooling a hot rolled steel material.

11. A method of production of a high strength thick steel material excellent in toughness and weldability as set forth in claim 10 characterized by heating the steel slab or billet to 1100 to 1350° C., then hot rolling to give a cumulative reduction rate at 1000° C. or less of 10% or more.

12. A method of production of a high strength thick steel material excellent in toughness and weldability as set forth in claim 10 or 11, characterized in that said hot rolling is comprised of primary rolling and secondary rolling and by rolling the steel slab or billet by primary rolling, then cooling the steel slab or billet to 500° C. or less, then reheating the steel slab or billet to a temperature region of 1100 to 1350° C., then rolling the steel slab or billet in secondary rolling to give a cumulative reduction rate at 1000° C. or less of 10% or more.

13. A method of production of a high strength thick steel material excellent in toughness and weldability as set forth in claim 10 characterized by, after said hot rolling, cooling the steel material in an average cooling rate of 0.1 to 10° C/s in a 800 to 500° C. temperature range.

14. A method of production of a high strength giant H-shape excellent in toughness and weldability as set forth in claim 8 or 9, said method of production giant H-shape characterized by smelting steel comprised of a composition of ingredients of claim 1 during which performing preliminary deoxidation to adjust the dissolved oxygen to 0.005 to 0.015 mass %, then adding Ti, furthermore vacuum degassing for 30 minutes or more for smelting, after smelting, continuously casting to produce a steel slab or billet, heating the steel slab or billet to 1100 to 1350° C., then hot rolling the steel slab or billet to produce a giant H-shape with a flange thickness of 40 mm or more, then cooling the giant H-shape.

15. A method of production of a high strength giant H-shape excellent in toughness and weldability as set forth in claim 14 characterized by heating the steel slab or billet to a temperature of 1100 to 1350° C., then hot rolling the steel slab or billet to give a cumulative reduction rate at 1000° C. or less of 10% or more.

16. A method of production of a high strength giant H-shape excellent in toughness and weldability as set forth in claim 14 characterized in that said hot rolling is comprised of primary rolling and secondary rolling and by rolling the steel slab or billet in primary rolling, then cooling the steel slab or billet to 500° C. or less, then reheating the steel slab or billet to a temperature region of 1100 to 1350° C., then rolling the steel slab or billet in secondary rolling to give a cumulative reduction rate at 1000° C. or less of 10% or more.

17. A method of production of a high strength giant H-shape excellent in toughness and weldability as set forth in claim 14 characterized by, after said hot rolling, cooling the giant H-shape in an average cooling fate of 0.1 to 10° C/s in a 800° C. to 500° C. temperature range.

18. A high strength thick steel material excellent in toughness and weldability as set forth in claim 1, characterized by containing, by mass %, C: 0.005% to 0.009%.

* * * * *